US005653215A

United States Patent [19]

Chung et al.

[11] Patent Number: 5,653,215

[45] Date of Patent: Aug. 5, 1997

[54] AIR-POWERED PROJECTILE LAUNCHER

[75] Inventors: Caleb Chung, Van Nuys; Steve Fouke, Marina Del Rey; John Handy, Long Beach; Terry Benson, West Hills; Nathan Proch, Los Angeles, all of Calif.

[73] Assignee: Mattel, Inc., El Segundo, Calif.

[21] Appl. No.: 386,616

[22] Filed: Feb. 9, 1995

[51] Int. Cl.[6] ..... F41B 11/14; F41B 11/18

[52] U.S. Cl. ..... 124/66

[58] Field of Search ..... 124/56, 65, 66, 124/67

[56] References Cited

U.S. PATENT DOCUMENTS

| | | | |
|---|---|---|---|
| 37,173 | 12/1862 | Linder . | |
| 179,526 | 7/1876 | Curtiss . | |
| 408,971 | 8/1889 | Hamilton . | |
| 507,470 | 10/1893 | Bailey . | |
| 1,065,556 | 6/1913 | Searle . | |
| 1,473,419 | 11/1923 | Cudlipp . | |
| 1,546,994 | 7/1925 | Parker . | |
| 1,760,652 | 5/1930 | Loomis | 124/67 |
| 2,029,036 | 1/1936 | Rottner . | |
| 2,156,797 | 5/1939 | Appleby | 124/67 |
| 2,542,777 | 2/1951 | Loew . | |
| 2,659,177 | 11/1953 | Kopf . | |
| 2,751,711 | 6/1956 | Greenwood . | |
| 2,993,297 | 7/1961 | Bednar et al. . | |
| 3,430,620 | 3/1969 | Davis . | |
| 3,540,426 | 11/1970 | Lohr . | |
| 3,895,459 | 7/1975 | Morrison et al. | 446/430 |
| 3,951,038 | 4/1976 | Van Langenhoven | 124/67 X |
| 4,076,006 | 2/1978 | Breslow et al. | 124/64 |
| 4,134,228 | 1/1979 | Ortiz | 446/225 |
| 4,367,723 | 1/1983 | Resuggan | 124/67 |
| 4,501,567 | 2/1985 | Cathell | 446/430 |
| 4,710,146 | 12/1987 | Rasmussen et al. | 446/308 |
| 4,848,307 | 7/1989 | Tsao | 124/59 |
| 5,242,323 | 9/1993 | Rappaport | 446/180 |

FOREIGN PATENT DOCUMENTS

| | | | |
|---|---|---|---|
| 137075 | 9/1947 | Austria . | |
| 3306 | of 1908 | United Kingdom | 124/67 |

*Primary Examiner*—John A. Ricci
*Attorney, Agent, or Firm*—Roy A. Ekstrand

[57] ABSTRACT

An air-powered projectile launcher includes a housing defining a cylindrical launch tube for receiving a projectile and a cylindrical cylinder bore. A piston having an extending piston rod is sealingly movable within the cylinder bore and is coupled at its forward end to a coil spring. The piston rod extends rearwardly through a trigger and cocking mechanism which in turn is coupled to a pivotal pump handle. A ratcheting mechanism is operatively coupled between the pivoting pump handle and the piston rod to facilitate the incremental drawing motion of the piston rod and piston stretching the power spring. The trigger mechanism holds the piston rod against the force of the stretched spring until the user pulls the trigger into its release position. Thereafter, the stored energy of the spring drives the piston forward against the launch tube and projectile providing an air burst which launches the projectile.

6 Claims, 3 Drawing Sheets

10
2
2
11
12
13
14
15
16
17
18
20
21
25
26
27
30
31
33
40
41
42
50
52
53
54

10
11
12
13
15
16
17
18
19
20
21
22
23
24
25
26
27
28
29
30
32
33
35
40
41
42
43
45
50
52
54
55
56
60
61
62
70
71
72
73
74
75
76
80
81
82
83
84
85
86
88
89
90
97
100
101

AIR-POWERED PROJECTILE LAUNCHER

FIELD OF THE INVENTION

This invention relates generally to projectile launchers and particularly to those utilizing a burst of pressurized air for projectile launch.

BACKGROUND OF THE INVENTION

Projectile launching toys have proven to be a very popular type of toy for a number of years. Not surprisingly, practitioners in the art have provided a variety of such toys utilizing various apparatus for providing projectile launch. Such launching apparatus have included the use of stored energy within a spring acting directly upon the projectile, the use of pressurized air acting upon the projectile which is either derived from a pressurized reservoir or a spring-driven pump of some sort, or combinations of these and other launching apparatus. The common factor of such projectile launching toys is to impart sufficient energy to the projectile to achieve successful launch.

The types of projectiles launched by such toys has been subject to substantial variation also. For example, projectile launching toys have been provided which launch simulated toy rockets, small toy airplanes, simulated "bullets" as well as various types of toy or simulated arrows.

Due to the long term popularity of such projectile launching toys, a variety of such devices are found within the prior art. For example, U.S. Pat. No. 37,173 issued to Lindner sets forth an AIR GUN having a pistol-shape housing supporting an elongated hollow barrel receiving a projectile therein. The pistol includes a spring driven plunger and means for drawing the plunger rearwardly against the spring and releasing it to pressurize air within the barrel and launch the projectile.

U.S. Pat. No. 408,971 issued to Hamilton sets forth an AIR GUN having a rifle-shaped housing defining an elongated hollow barrel and an internalized pressurizable cylinder coupled thereto. A spring-driven plunger is movable within the barrel and is operated by a cocking mechanism to be drawn rearwardly and released forcing pressurized air outwardly through the hollow barrel launching the projectile.

U.S. Pat. No. 179,526 issued to Curtiss sets forth a TOY PISTOL having an elongated barrel coupled to a pistol housing within which a plunger is movably supported. A spring is coupled to the plunger and an operative mechanism is provided which draws the plunger rearwardly against the spring producing a launching force.

U.S. Pat. No. 1,065,556 issued to Searle sets forth a MAGAZINE AIR RIFLE having a rifle housing supporting an elongated barrel and a movable piston in communication therewith. A spring is coupled to the piston and a cocking mechanism draws the piston rearwardly against the spring and a trigger releases the captive piston to provide a burst of air. Also shown is a projectile magazine which inserts a projectile each time the device is cocked.

U.S. Pat. No. 507,470 issued to Bailey sets forth a REPEATING AIR GUN having a hollow barrel coupled to an air cylinder having a spring-loaded piston therein. A mechanism is provided for drawing the piston rearwardly against the spring and for releasing to launch a projectile within the barrel. A magazine supports a plurality of projectiles proximate to the barrel which are inserted each time the device is cocked.

U.S. Pat. No. 2,542,777 issued to Loew sets forth a PELLET PROJECTING TOY GUN having a pellet receiving barrel coupled to an air cylinder within which a spring-loaded piston is supported. A cocking mechanism draws the piston rearwardly against the spring and a trigger mechanism operates to release the captive piston providing a burst of air.

U.S. Pat. No. 4,848,307 issued to Tsao sets forth a TOY AIR PISTOL FOR LAUNCHING MISSILE BULLET having a pistol-shape housing supporting a rotating multiple bore cylinder in communication with a barrel. Means are provided for rotating the cylinder bearing a plurality of missile bullets therein sequentially into alignment with the barrel and for providing a burst of pressurized air to launch the missile bullet.

U.S. Pat. No. 3,540,426 issued to Lohr, et al. sets forth an AIR GUN having an elongated hollow barrel coupled to a collapsible closed end bellows. A spring-loaded plunger is aligned with the collapsible bellows and is urged toward the bellows by a drive spring. A cocking and trigger means are provided for drawing the plunger away from the bellows against the spring and releasing the plunger to engage the bellows and rapidly compress it producing pressurized air within the barrel and launching the projectile.

U.S. Pat. No. 1,473,419 issued to Cudlipp; U.S. Pat. No. 1,546,994 issued to Parker; and U.S. Pat. No. 2,029,036 issued to Rottner set forth toy pistols or guns for launching a toy airplane or the like.

U.S. Pat. No. 2,659,177 issued to Kopf sets forth a BUBBLE BLOWING GUN having a spring-driven air plunger in a pistol-shaped housing directed toward a bubble blowing apparatus.

U.S. Pat. No. 2,993,297 issued to Bednar, et al. and U.S. Pat. No. 4,076,006 issued to Breslow, et al. set forth pneumatic rocket launchers utilizing a collapsible bladder which is compressed by the user's foot or hand to launch the rocket.

U.S. Pat. No. 5,242,323 issued to Rappaport sets forth a AIR-PULSE POWERED TOY BOW AND ARROW SET having a simulated crossbow supporting a projectile launching barrel coupled to a spring-driven air plunger. The barrel includes a hollow launch tube which receives a closed end hollow projectile resembling an arrow.

U.S. Pat. No. 4,134,228 issued to Ortiz sets forth an INFLATED TOY BALLOON LAUNCHER having a pistol-shaped housing to which a balloon projectile is coupled together with means operative in response to trigger movement for inflating the balloon to an extent sufficient to launch the balloon and projectile from the pistol housing.

U.S. Pat. No. 2,751,711 issued to Greenwood; U.S. Pat. No. 4,710,146 issued to Rasmussen, et al; and U.S. Pat. No. 3,430,620 issued to Davis set forth various missile launching toy guns.

U.S. Pat. No. 4,501,567 issued to Cathell and U.S. Pat. No. 3,895,459 issued to Morrison, et al. set forth toy vehicle launching devices having handheld actuators.

Australian Patent 137,075 issued to Wiggins sets forth an improved TOY GUN having a frame supporting a cylindrical barrel within which a spring-driven plunger is supported. A trigger mechanism is provided which includes a pivotally secured trigger level having an aperture therethrough which receives the plunger shaft. The lever is movable by a spring and is urged toward a position gripping the shaft. The trigger is released by the user overcoming the spring force and drawing the pivoting lever into a generally perpendicular relationship with the shaft.

While the foregoing described prior art devices have improved the art and have, in many instances, enjoyed commercial success, there remains nonetheless a continuing need in the art for evermore improved air powered projectile launchers.

SUMMARY OF THE INVENTION

Accordingly, it is a general object of the present invention to provide an improved projectile launcher. It is a more particular object of the present invention to provide an improved air-powered projectile launcher. It is a still more particular object of the present invention to provide an improved air-powered projectile launcher having a novel plunger cocking mechanism and trigger release.

In accordance with the present invention, there is provided for use in launching a projectile having a closed end projectile bore defined therein, a projectile launcher comprising: a housing defining a cylinder bore and a launch tube having an interior passage communicating with the cylinder bore; a piston sealingly movable within the cylinder bore between a first position proximate the launch tube and a second position farther from the launch tube; a piston rod having a first end attached to the piston and a second end extending away from the launch tube; a handle pivotally coupled to the housing pivotable between first and second positions; one-way drive means operatively coupled between the handle and the piston rod for moving the piston rod away from the launch tube an incremental distance each time the handle is moved from the first position to the second position and releasing the piston rod each time the handle is moved from the second position to the first position; trigger means for holding the piston rod when the handle is moved from the second position to the first position and for releasing the piston rod when actuated; and a power spring coupled to the piston urging the piston toward the launch tube.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
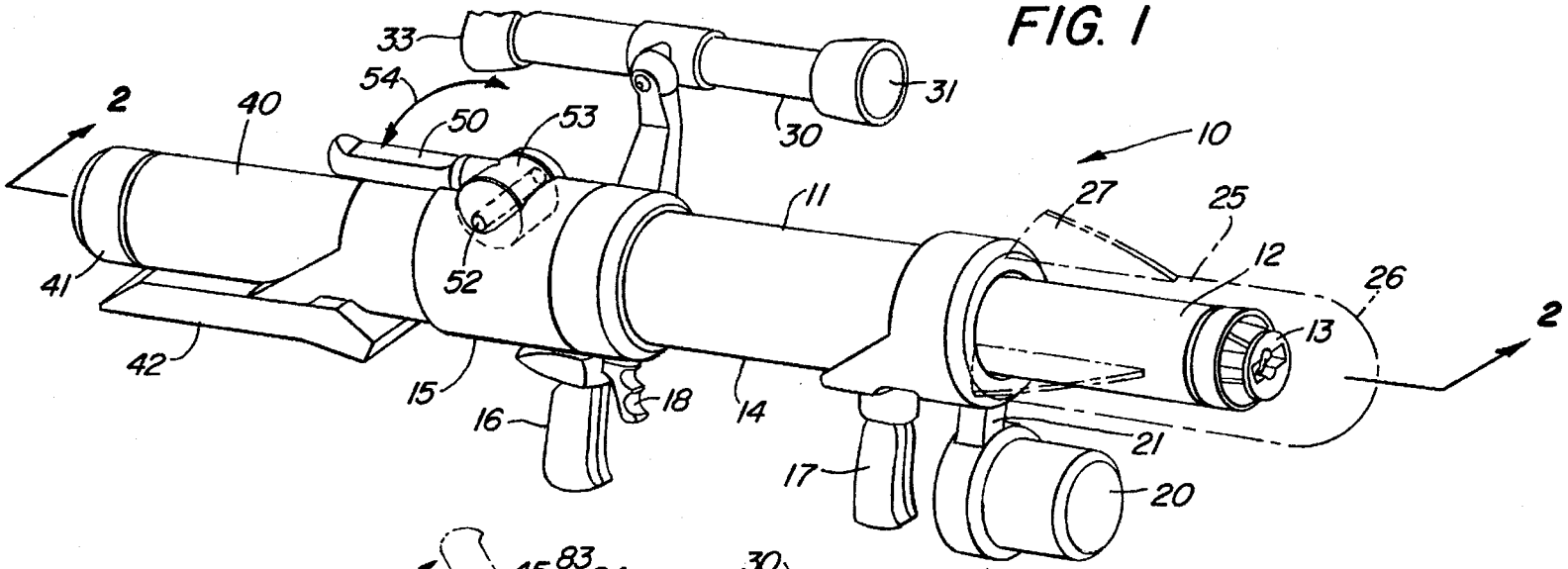
FIG. 1 sets forth a perspective view of an air-powered projectile launcher constructed in accordance with the present invention.

FIG. 1 sets forth a perspective view of a projectile launcher constructed in accordance with the present invention and generally referenced by numeral 10. Projectile launcher 10 includes a housing 11 having a cylinder 14 coupled to a cylindrical launch tube 12. As is better seen in FIG. 2, launch tube 12 and cylinder 14 are hollow defining respective cylindrical bores therein. Projectile launcher 10 further includes a spring bracket 13 supported at the forward end of launch tube 12. Spring bracket 13 is coupled to spring end 61 of spring 60 supported within launch tube 12 and better seen in FIG. 2. Housing 11 further includes a pair of downwardly extending pistol grip handles 16 and 17. A pivotally supported trigger 18 extends from handle 16 beneath cylinder 14. Housing 11 further includes a generally cylindrical trigger housing having a shoulder rest 42 extending downwardly therefrom. Trigger housing 15 further supports a cylindrical portion 53 pivotally coupled to housing 15 by a pivot 52. A pump handle 50 extends outwardly from cylindrical portion 53. Pump handle 50 and cylindrical portion 53 are pivotally movable about pivot 52 in the directions indicated by arrows 54. Housing 11 further includes a rearwardly extending plunger rod housing 40 defining a generally cylindrical shape and having a closed end 41 formed thereon. An angularly disposed sight bracket 32 extends outwardly and upwardly from trigger housing 15 and supports an elongated cylindrical sight tube 30. Sight tube 30 defines a sight bore 31 extending therethrough and an eyepiece 33 at the rearward end thereof.

Projectile launcher 10 further includes a downwardly extending support 21 having a cylindrical projectile holder 20 extending forwardly beneath launch tube 12. Projectile holder 20 defines a cylindrical diameter corresponding to that of launch tube 12.

A projectile shown in dashed-line representation and generally referenced by numeral 25 defines a closed end 26 and a plurality of outwardly extending fins 27. As is better seen in FIG. 2, projectile 25 further defines a cylindrical closed end bore 28 permitting projectile 25 to be snugly received upon launch tube 12. Because the diameters of projectile holder 20 and launch tube 12 are substantially the same, a projectile such as projectile 25 may be supported upon projectile holder 20 by simply sliding the projectile bore partially over projectile holder 20. This facilitates the easy carrying of a second projectile in addition to the projectile loaded upon launch tube 12 in the manner shown in FIGS. 1 and 2.

In operation and as is set forth below in greater detail, the user pivots pump handle 50 back and forth about pivot 52 in the directions indicated by arrows 54 causing an internally disposed piston 70 (seen in FIG. 2) to be drawn rearwardly within cylinder 14 against an elongated coil spring 60 supported within launch tube 12 and also better seen in FIG. 2. Once the user has through a succession of pivoting motions of pump handle 50 drawn piston 70 a sufficient distance against spring 60, trigger 18 engages and restrains piston 70 by means set forth below in greater detail. At this point, projectile launcher 10 is cocked and ready to operate. The user then loads a projectile such as projectile 25 upon launch tube 12 and thereafter while holding projectile launcher 10 using handles 16 and 17 preferably holds projectile launcher 10 in the position normally described as a shoulder fired weapon. When so held, shoulder rest 42 rests upon the user's shoulder and sight tube 30 is generally aligned with the user's eye permitting the user to place eyepiece 33 proximate to one of the user's eyes and utilize sight tube 30 to aim the projectile launcher. Thereafter, firing is accomplished by squeezing trigger 18 against handle 16 which by means set forth below in greater detail releases the captive piston within cylinder 14 producing an air burst which is driven into launch tube 12 and launches projectile 25 from projectile launcher 10. The cycle may then be repeated by again manipulating pump handle 50 and thereafter loading a projectile upon launch tube 12 and once again firing projectile launcher 10.

The resulting operation of projectile launcher 10 provides the user with an entertaining and exciting play pattern in which the multiple pivoting manipulations of pump handle 50 are able to store substantial energy within the projectile launching mechanism of launcher 10. To add further to the user's interest and excitement, the configuration of projectile launcher 10 simulates a shoulder fired weapon such as a "stinger missile" or the like. The provision of sight tube 30 further enhances the realism and play value of the projectile launcher. Finally, the present invention projectile launcher is capable of substantial launch power and, as a result, is able to launch projectiles of a substantially greater diameter and size than customarily launched by prior art launchers. In its preferred form, projectile 25 is fabricated of a soft foam plastic material or the like to provide a relatively rigid but safe and noninjurious type projectile.

Figure 2:
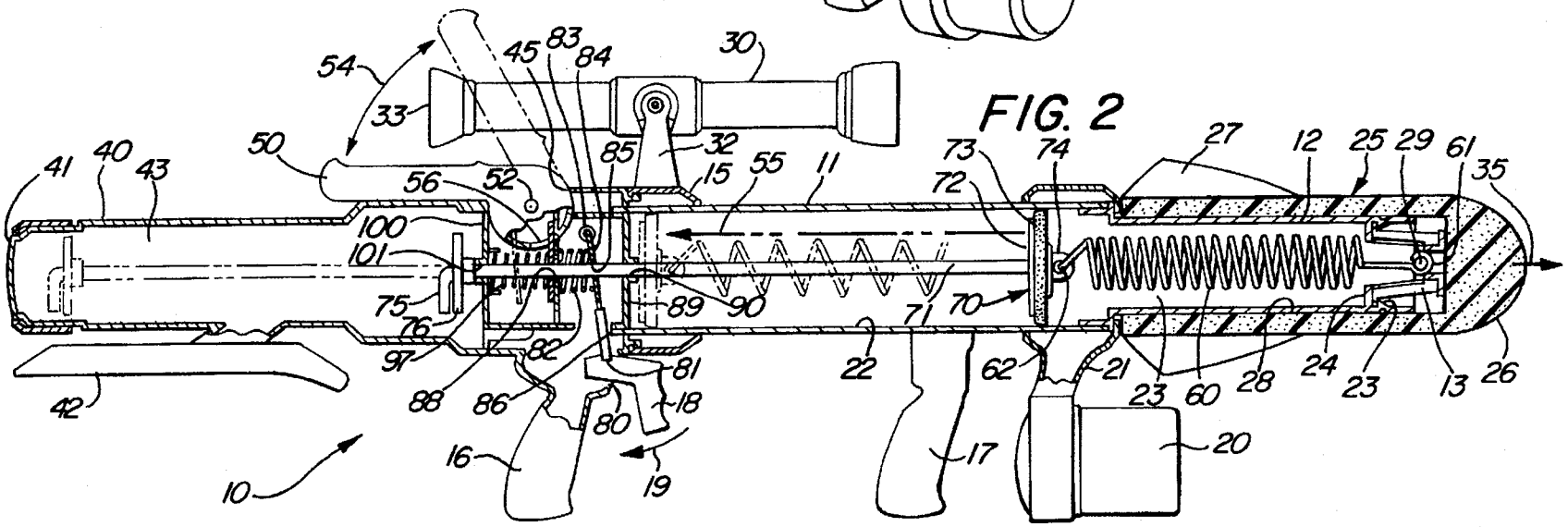
FIG. 2 sets forth a section view of the present invention air-powered projectile launcher taken along section lines 2—2 in FIG. 1.

FIG. 2 sets forth a section view of projectile launcher 10 taken along section lines 2—2 in FIG. 1. Projectile launcher 10 includes a housing generally referenced by numeral 11 having a cylindrical portion 14 coupled to a forwardly extending generally cylindrical launch tube 12. Cylinder 14 defines an interior piston bore 22 which is in communication with a passage 23 formed within launch tube 12. Launch tube 12 includes an inwardly extending rib 24 and an angled rib 23 spaced apart. A spring bracket 13 is received within the open end of launch tube 12 and is snap-fit engaged between ribs 23 and 24 to secure spring bracket 13 within the end portion of launch tube 12. Bracket 13 includes a plurality of apertures extending therethrough and a transversely extending pin 29. Pin 29 receives end 61 of a coil spring 60 securing end 61 to bracket 13. Spring 60 extends into launch tube 12 and defines an end 62 at the interior thereof.

Housing 11 further includes a pair of downwardly extending handles 16 and 17. A projectile holder support 21 encircles the forward end of cylindrical portion 14 and extends downwardly supporting a generally cylindrical projectile holder 20. Projectile holder 20 is approximately the same diameter as the outer diameter of launch tube 12 and thus is able to receive and conveniently hold an additional projectile. Projectile launcher 10 further includes a trigger housing 15 supporting handle 16 and defining a hollow interior within which a wall 89 having an aperture 90 defined therein is supported. Trigger housing 15 further supports a wall 87 having an aperture 88 aligned with aperture 90 formed therein. Finally, trigger housing 15 includes a rear wall 100 having an aperture 101 commonly aligned with apertures 88 and 90 formed therein. Housing 11 further includes a rearwardly extending plunger rod housing 40 having a closed end 41 and defining an interior cavity 43. A shoulder rest 42 is secured to plunger rod housing 40 and extends generally parallel thereto.

A piston rod 70 extends through aperture 90 of wall 89, aperture 88 of wall 87, and aperture 101 of wall 100. Piston rod 71 terminates beyond wall 100 in a right angled end 75 which in turn captivates an end plate 76. The forward end of piston rod 71 extends forwardly toward launch tube 12 and terminates in an end tab 74 having an aperture formed therein. A piston flange 72 and resilient piston seal 73 are received upon and secured to tab 74 of piston rod 71. A coil spring 60 having end 61 secured to bracket 13 by pin 29 includes an end 62 coupled to tab 74 of piston rod 71. Spring 60 is a conventional coil spring formed to provide a spring force tending to urge piston rod 71 and piston 70 formed by the combination of seal 73 and flange 72 forwardly toward the junction of launch tube 12 and cylindrical portion 14. Thus, the natural or relaxed position of spring 60 corresponds generally to the solid line drawing thereof in FIG. 2.

Figures 3, 4:
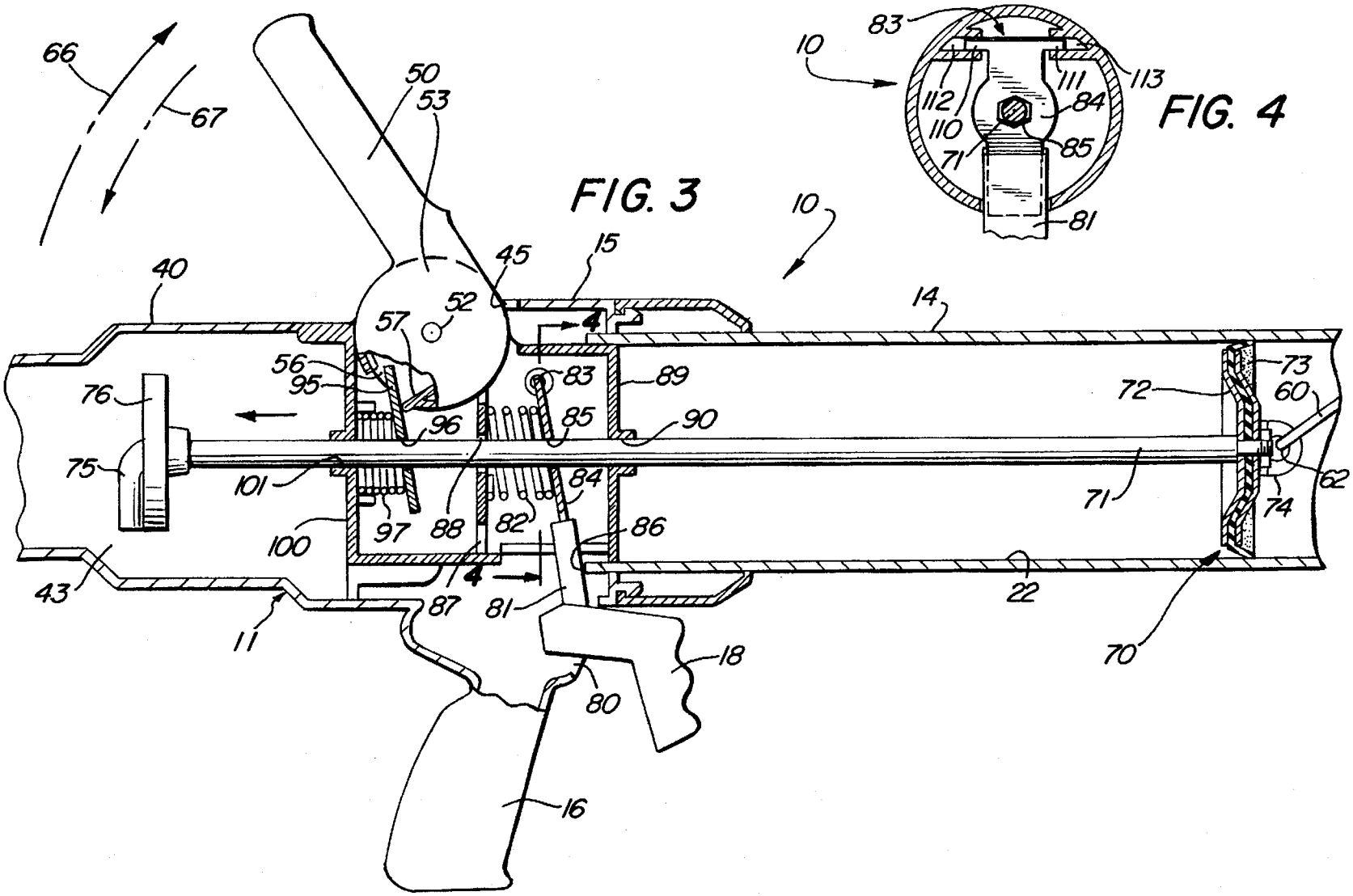
FIG. 3 sets forth a partial section view of the present invention air-powered projectile launcher.
FIG. 4 sets forth a section view of the present invention air-powered projectile launcher taken along section lines 4—4 in FIG. 3.

Projectile launcher 10 further includes a generally planar trigger plate 84 pivotally secured within trigger housing 15 at a pivot attachment 83 in the manner better seen in FIG. 4. As is also better seen in FIG. 4, trigger plate 84 defines an aperture 85 through which piston rod 71 passes. Trigger plate 84 extends downwardly beyond piston rod 71 and is received within an attachment 81 which secures trigger plate 84 and trigger 18 in a fixed attachment. Trigger 18 extends inwardly through aperture 80 formed in handle 16 and outwardly beyond handle 16 to be accessible to the user in the manner described below. A coil spring 82 is received upon piston rod 81 and is captivated between wall 87 and trigger plate 84. Spring 82 provides an expanding force which urges trigger plate 84 forwardly in a pivotal movement which in turn pivots trigger 18 forwardly and upwardly until attachment 81 contacts stop 86 provided by the rear edge of cylindrical portion 14. Projectile launcher 10 further includes a plate 95 defining an aperture 96 which receives piston rod 71. A coil spring 97 is received upon piston rod 71 and captivated between rear wall 100 of trigger housing 15 and interior wall 87. Spring 97 provides a spring force urging plate 95 forwardly against wall 87 in the position shown in FIG. 2.

Projectile launcher 10 further includes a pump handle 50 having a cylindrical portion 53 received within an elongated aperture 45 formed in trigger housing 15. A pivot 52 pivotally secures pump handle 50 providing pivotal motion thereof in the manner indicated by arrows 54. Cylindrical portion 53 of pump handle 50 is hollow and defines an elongated aperture 56 which receives the upper end of plate 95. Projectile launcher 10 further includes a bracket 32 extending upwardly and outwardly from trigger housing 15 which in turn supports an elongated cylindrical hollow sight tube 30 having an eyepiece 33. A projectile 25 preferably formed of a lightweight somewhat resilient foam plastic material or the like defines a closed end 26 and a cylindrical interior bore 28. Projectile 25 further includes a plurality of outwardly extending fins 27. Projectile 25 is received upon launch tube 12 in a simple slide on attachment to the position shown in FIG. 2. In addition, a second projectile having an interior bore such as bore 28 of projectile 25 may be conveniently stored upon projectile holder 20 and carried along with projectile launcher 10.

In operation, projectile launcher 10 assumes the position shown in FIG. 2 following the discharge of the launcher and prior to recharging or cocking the launcher in preparation for firing a projectile. Projectile launcher 10 is prepared for firing by initially removing projectile 25 from launch tube 12 and thereafter pivoting pump handle 50 about pivot 52 up and down in the directions indicated by arrows 54. The user pumps handle 50 repeatedly to fully prepare projectile launcher 10 for receiving and launching a projectile. The operation of pump handle 50 and the energizing and trigger mechanism of projectile launcher 10 are set forth below in FIGS. 3 through 5 in greater detail. However, suffice it to note here that each pivotal motion of pump handle 50 upwardly to the position shown in dashed-line representation causes plate 95 to be pivoted and forced against piston rod 71 thereby causing plate 95 to grip piston rod 71. With plate 95 gripping piston rod 71, the continued pivotal motion of pump handle 50 upwardly draws piston rod 71 rearwardly in the direction indicated by arrow 55 by an incremental distance stretching spring 70. During the rearward motion in the direction of arrow 55 of piston rod 71, trigger plate 84 is carried rearwardly in a pivotal motion permitting piston rod 71 to slide through aperture 85 of trigger plate 84. Once pump handle 50 reaches the fully upward dashed-line position shown in FIG. 2, the user then returns pump handle 50 downwardly to the solid-line position shown. During each downward stroke of pump handle 50, spring 97 returns plate 95 to the position shown in FIG. 2 and trigger plate 84 grips piston rod 71. Thus, a single direction or ratcheting action occurs as pump handle 50 is pumped up and down in which each upward pivotal stroke of pump handle 50 draws piston rod 71 in the direction of arrow 55 stretching spring 60 and each downward stroke of pump handle 50 releases piston rod 71 which is held by trigger plate 84 until the next pump handle stroke. Thus, repeated up and down motions of pump handle 50 incrementally draw piston rod 71 rearwardly extending end 75 to the dashed line position shown in FIG. 2 and correspondingly moving piston 70 to the dashed-line position shown proximate wall 89. The motion of piston 70 stretches spring 60 storing a substantial energy in spring 60.

Once projectile 10 has been prepared for projectile launch, a projectile such as projectile 25 is placed upon launch tube 12 in the position shown in FIG. 2. Thereafter, the user fires launcher 10 by simply grasping trigger 18 and pivoting trigger 18 in the direction indicated by arrow 19 which releases the grip of trigger plate 84 upon piston rod 71 allowing spring 60 to rapidly return piston 70 to the forward position shown in FIG. 2. Seal 73 provides an air-tight seal against bore 22 of cylinder 14 with the result that pressurized air is forced through passage 23 of launch tube 12 and spring bracket 13 against closed end 26 of projectile 25 causing it to be launched or fired.

At the completion of each firing operation, the user then manipulates pump handle 50 once again to draw piston rod 71 rearwardly and displace piston 70 and stretch spring 60. The projectile launcher is then ready to receive another projectile and fire it once trigger 18 is pressed. It should be noted that spring bracket 13 is configured to provide ample air flow capability from launch tube 12 while precluding the intrusion of foreign elements into the interior of launch tube 12. This provides a safety factor in which the user is precluded from introducing unintended and potentially dangerous projectiles into the launch tube. The use of pivotal motion of pump handle 50 to draw the piston rod and piston back to the loaded position provides substantial mechanical advantage allowing younger children to manipulate the projectile launcher without being exposed to potential injury. This mechanical advantage of multiple cocking strokes facilitates the use of a strong piston spring and thereby provides the present invention projectile with the ability to launch large lightweight projectiles notwithstanding the substantial air resistance offered by such larger lightweight projectiles. In addition, the pumping action of pump handle 50 has been found to impart an entertaining and exciting play pattern to the present invention projectile launcher and thus increases the entertainment and play value of the launcher. It will be apparent to those skilled in the art that while an exemplary projectile having a rocket-like shape is shown in FIGS. 1 and 2, other shaped projectiles may be utilized which define an interior bore similar to bore 28 and are thus launchable in response to a burst of compressed air against the bore interior.

Figure 5:
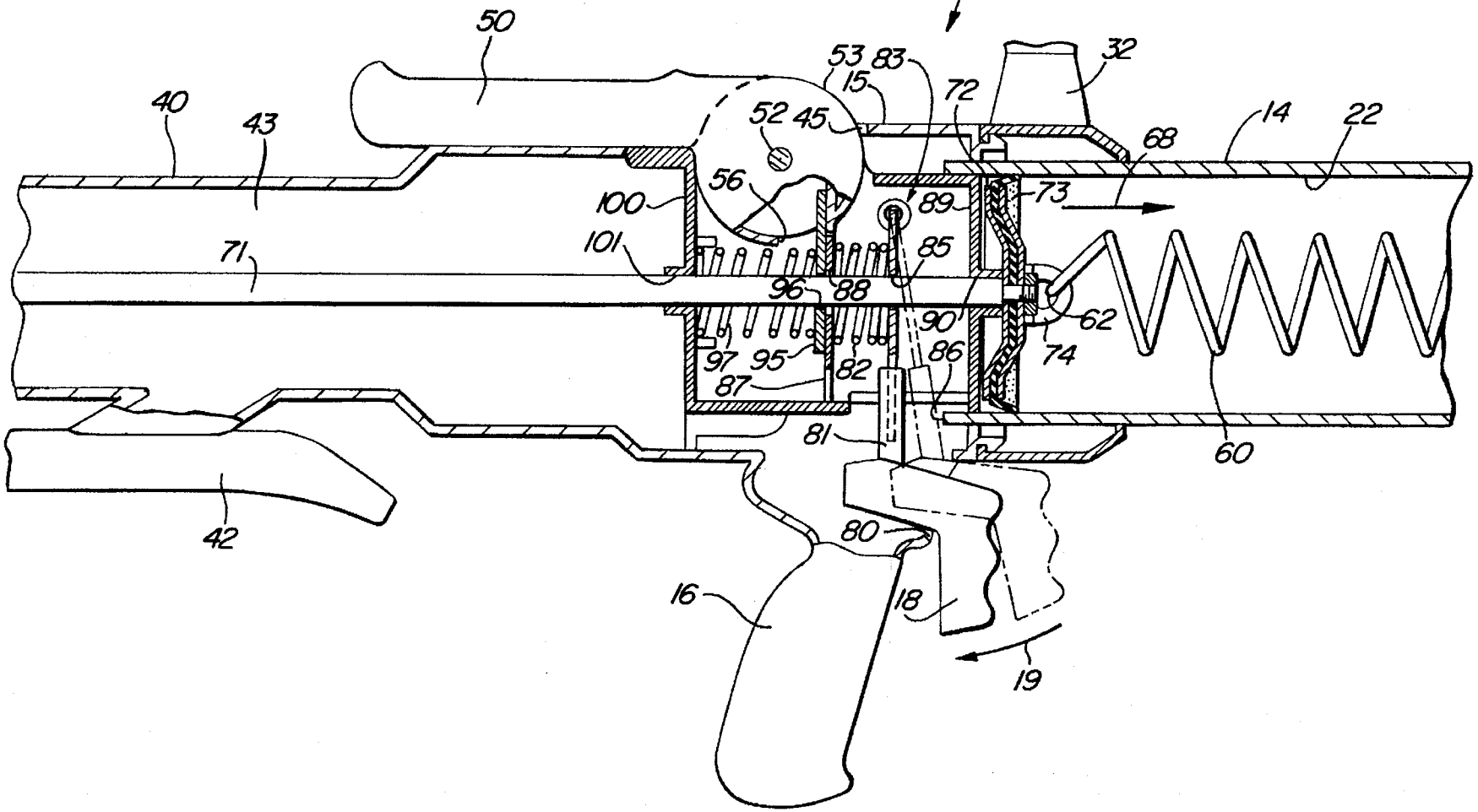
FIG. 5 sets forth a partial section view of the present invention air-powered projectile launcher during trigger release.

FIGS. 3 and 5 set forth similar section views of the cocking and trigger mechanism of the present invention projectile launcher during different phases of its operative cycle. FIG. 3 sets forth the present invention launcher during the cocking or loading cycle as the pump handle is manipulated to draw the piston and piston rod rearwardly and store energy within the spring. FIG. 5 on the other hand shows a section view of the fully cocked or loaded configuration of the present invention projectile launcher and depicts the moment of trigger release and projectile firing.

More specifically, FIG. 3 sets forth a section view of the cocking and trigger mechanism of the present invention projectile launcher. As described above, launcher 10 includes a housing 11 having a cylindrical portion 14 defining an interior bore 22. Cylindrical portion 14 is coupled to a trigger housing 15 having interior walls 89, 87 and 100 formed therein which in turn define apertures 90, 88 and 101 respectively in a common axis alignment. Housing 11 further includes a plunger rod housing 40 extending rearwardly from trigger housing 15. A handle 16 extends downwardly from trigger housing 15 and defines an aperture 80 therein. A generally planar trigger plate, the structure of which is better seen in FIG. 4, is pivotally secured within trigger housing 15 at a pivotal attachment 83. Trigger plate 84 defines an aperture 85 and extends downwardly into an attachment 81 formed on trigger 18. Thus, the combination of trigger plate 84, attachment 81 and trigger 18 forms an integral unit having substantial rigidity which is pivotally secured at pivot 83 causing trigger 18 to be movable within aperture 80. Projectile launcher 10 further includes a generally planar plate 95 positioned between walls 87 and 100 and defining an aperture 96. An elongated piston rod 71 extends through apertures 90, 88 and 101 in walls 89, 87 and 100 respectively. Piston rod 71 terminates within plunger rod housing 40 in a right angled end 75 which in turn supports a plate 76. Piston rod 71 also passes through apertures 85 and 96 formed in trigger plate 84 and plate 95 respectively. A coil spring 82 is received upon piston rod 71 and is captivated between wall 87 and trigger plate 84. Spring 82 provides an expanding spring force which urges trigger plate 84 to the forward pivotal position shown in FIG. 3 in which attachment 81 is brought into contact with stop 86 thereby limiting further pivotal motion of trigger 18. An additional coil spring 97 is received upon piston rod 71 and is captivated between wall 100 and plate 95. Spring 97 provides a spring force urging plate 95 forwardly toward wall 87.

An elongated pump handle 50 includes a cylindrical portion 53 extending into aperture 45 formed in trigger housing 15 and pivotally secured by a pivot 52. Cylindrical portion 53 further defines an aperture 56 and a downwardly extending tab 57. Aperture 56 receives the upper end of plate 95.

Piston rod 71 further supports a piston 70 formed by a flange 72 and a resilient seal 73. A tab 74 extends from piston rod 71 and is coupled to end 62 of coil spring 60.

In operation and as described briefly above, the present invention projectile launcher is prepared for projectile launch by the user's pivoting motion of pump handle 50. Thus, each time the user pivots pump handle 50 upwardly in the direction indicated by arrow 66, tab 57 of cylindrical portion 53 is forced against the upper portion of plate 95. While the motion of plate 95 is resisted by spring 97, the force of tab 57 above spring 97 causes plate 95 to be pivoted with respect to piston rod 71. As plate 95 pivots to the position shown in FIG. 3, plate 95 grips piston rod 71 at aperture 96. As pump handle 50 continues to be pivoted upwardly in direction indicated by arrow 66 the force of spring 97 is overcome and as plate 95 continues to grip piston rod 71 the pivotal motion of pump handle 50 forces the combination of plate 95 and piston rod 71 rearwardly in the direction indicated by arrow 65. This motion continues until pump handle 50 reaches its topmost position and spring 97 is fully compressed. The rearward motion of piston rod 71 draws piston 70 against the force of spring 60 stretching spring 60 and storing energy therein. The motion of piston rod 71 in the direction indicated by arrow 75 as pump handle 50 pivots is not resisted by trigger plate 84 due to the slight pivoting of trigger plate 84 against spring 82. Thus, the upward stroke of pump handle 50 provides an incremental rearward motion in the direction indicated by arrow 65 for piston rod 71 and piston 70.

At the completion of each upward stroke of pump handle 50, the user then pivots pump handle 50 downwardly in the direction indicated by arrow 67 which releases tab 57 from plate 95 and allows spring 97 to return plate 95 to a generally vertical alignment thereby releasing the grip of plate 95 upon piston rod 71. Under the urging of spring 60, piston rod 71 thereafter attempts to move forwardly. However, as piston rod 71 attempts to move forwardly, the combination of friction against aperture 85 of trigger plate 84 together with the force of spring 82 pivots trigger 18 about pivot 83 in the counterclockwise direction causing aperture 85 of trigger plate 84 to grip piston rod 71 and prevent its return to the previous position. Thus, trigger plate 84 holds the position of piston rod 71 and piston 70 against the force of spring 60 following each upward stroke of pump handle 50 and during each downward stroke in the direction indicated by arrow 67. As pump handle 50 is pivoted downwardly to the position shown in FIG. 2, plate 95 is completely released and is forced forwardly against wall 87. Thereafter, the next pivotal motion in the direction of arrow 66 of pump handle 50 again brings tab 57 into contact with plate 95 causing it to assume the angled gripping orientation shown in FIG. 3 whereby continued upward pivotal motion of pump handle 50 draws piston rod 71 in the direction of arrow 65 for the next incremental distance. At the completion of the upward pivotal motion by pump handle 50, piston rod 71 has been drawn against spring 60 by an additional incremental distance.

Thus, as the user moves pump handle 50 up and down in the directions indicated by arrows 66 and 67, plate 95 and trigger plate 84 cooperate to provide a single direction motion or ratcheting action upon piston rod 71 which incrementally draws piston rod 71 against spring 60 thereby drawing piston 70 toward wall 89. Once piston 70 has been drawn against wall 89, the manipulation of pump handle 50 is terminated and the present invention projectile launcher assumes the firing configuration shown in FIG. 5. In the firing configuration, the gripping action of trigger plate 84 at aperture 85 provides the sole restraint against the force of stretched spring 60.

FIG. 4 sets forth a section view of the trigger mechanism of the present invention projectile launcher taken along section lines 4—4 in FIG. 3. Thus, projectile launcher 10 includes a cylindrical portion of trigger housing 15 which in turn includes a pair of oppositely positioned sockets 112 and 113. Trigger plate 84 defines a generally planar member having a pair of tabs 110 and 111 at the upper portion thereof which are received within sockets 112 and 113 respectively to provide pivot 83 for attachment of trigger plate 84. Trigger plate 84 extends downwardly and is received within an attachment 81 which in turn is secured to trigger 18 (seen in FIG. 3). Trigger plate 84 defines a hexagonal-shaped aperture 85 which receives piston rod 71. The hexagonal shape of aperture 85 improves the gripping characteristic of trigger plate 84 upon piston rod 71. Thus, trigger plate 84 is able to resist the entire force of stretched spring 60 (seen in FIG. 5) when the present invention projectile launcher is configured in the fully energized or loaded position.

FIG. 5 sets forth a partial section view of the present invention projection launcher corresponding to that of FIG. 3 fully prepared for projectile launch. Thus, FIG. 5 differs from the configuration shown in FIG. 3 in that the above-described cocking operation of the user by pivoting pump handle 50 has drawn piston rod 71 and piston 70 to the fully loaded position stretching spring 60 and storing substantial energy therein. As described above with pump handle 50 in the position shown in FIG. 5, plate 95 is forced against wall 87 by spring 97 thereby releasing the grip of plate 95 upon piston rod 71. Conversely, the force of spring 82 urges trigger plate 84 forwardly against stop 86 in the position shown in dashed-line representation in FIG. 5. The angular relationship between trigger plate 84 and piston rod 71 caused by this position of trigger plate 84 causes aperture 85 of trigger plate 84 to grip piston rod 71 securely and prevents the forward movement of piston rod 71 and piston 70 despite the substantial force of spring 60.

Thus, in the configuration shown in FIG. 5, the present invention projectile launcher is fully prepared for projectile launch and has substantial energy stored within spring 60. The trigger release for firing the projectile launcher is accomplished by simply squeezing trigger 18 toward handle 16 in the direction indicated by arrow 19 which in turn pivots trigger 84 into a substantially vertical position in which trigger plate 84 is generally perpendicular to piston rod 71. In this perpendicular position, a sufficient clearance is provided between aperture 85 of trigger plate 84 and piston rod 70 to release the grip of trigger plate 84 upon the piston rod. Once the grip of trigger plate 84 is released, the stored energy within spring 60 rapidly draws piston 70 and piston rod 71 forwardly in the direction indicated by arrow 68. As spring 60 continues to draw piston 70 forwardly, the captive air within bore 22 of cylindrical portion 14 is compressed producing a burst of high pressure air which as is better seen in FIG. 2 is driven into passage 23 of launch tube 12 and against closed end 26 of projectile 25. As piston 70 continues to be rapidly moved forward, the pressure within launch tube 12 increases abruptly and projectile 25 is launched with substantial energy.

Once the firing cycle is complete, the present invention projectile launcher is again prepared for the next projectile launch by repeating the energy storing or cocking operation described in conjunction with FIG. 3 to return the projectile launcher to the firing configuration shown in FIG. 5.

What has been shown is an improved air-powered projectile launcher having a cocking mechanism which facilitates the use of a substantially stronger drive spring than provided by prior art projectile launchers. The projectile launcher further includes a simple trigger mechanism which reliably maintains the stored spring energy in the launcher until the desired projectile launch is undertaken. The projectile launcher shown is able to impart substantial energy to the projectile and thus is able to launch lightweight, high air resistance projectiles which provide safe operation and which are nonetheless capable of substantial flight distances.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in launching a projectile having a closed end projectile bore defined therein, a projectile launcher comprising:

a housing defining a cylinder bore, a rear wall defining a wall aperture therethrough and a launch tube, said launch tube having an interior passage communicating with said cylinder bore and a forward end;

a piston sealingly movable within said cylinder bore between a first position within said cylinder bore proximate said launch tube and a second position spaced from said launch tube;

a piston rod having a first end attached to said piston and a second end extending away from said launch tube and passing through said wall aperture;

a handle pivotally coupled to said housing pivotable between first and second positions;

one-way drive means operatively coupled between said handle and said piston rod for moving said piston rod away from said launch tube an incremental distance each time said handle is moved from said first position to said second position and releasing said piston rod each time said handle is moved from said second position to said first position, said one-way drive means including a plate defining an aperture through which said piston rod slidably extends and a spring urging said plate against said wall;

trigger means for holding said piston rod when said handle is moved from said second position to said first position and for releasing said piston rod when actuated; and a power spring having a first end coupled to said piston and a second end coupled to said launch tube, said power spring urging said piston toward said launch tube.

2. A projectile launcher as set forth in claim 1 wherein said launch tube includes a spring bracket and wherein said first end of said power spring is connected to said spring bracket.

3. A projectile launcher as set forth in claim 2 wherein said trigger means includes:

a pivotable trigger plate defining an aperture through which said piston rod passes, said trigger plate gripping said piston rod when pivoted away from an orthogonal relationship and releasing said piston rod when generally orthogonal to said piston rod;

a trigger spring urging said trigger plate away from said orthogonal relationship; and a trigger coupled to said trigger plate for pivoting said trigger plate to said generally orthogonal relationship to release said piston rod.

4. For use in launching a projectile having a closed end projectile bore defined therein, a projectile launcher comprising:

housing defining a cylindrical bore and a launch tube, said projectile being receivable upon said launch tube;

a piston movable within said cylindrical bore between a first position proximate said launch tube and a second position spaced from said launch tube;

a power spring urging said piston toward said first position;

a piston rod extending from said piston;

trigger means for releasibly gripping said piston rod; and cocking means for drawing said piston toward said second position against the urging of said power spring, said cocking means including a plate defining an aperture through which said piston rod passes, a lever movable to engage said plate and pivot said plate to grip said piston rod and draw it toward said second position.

5. A projectile launcher as set forth in claim 4 wherein said cocking means includes:

a fixed wall extending into said cylindrical bore and defining an opening through which said piston rod passes; and a plate spring urging said plate against said wall, said plate releasing said piston rod when forced against said wall and gripping said piston rod when moved by said lever.

6. A projectile launcher as set forth in claim 5 wherein said power spring is coupled between said piston and said launch tube and is stretched to store energy when said piston is drawn toward said second position.

* * * * *